US005116425A

United States Patent [19]

Ruef

[11] Patent Number: 5,116,425

[45] Date of Patent: May 26, 1992

[54] CLEANING METHOD

[75] Inventor: Helmut Ruef, Charlotte, N.C.

[73] Assignee: Softblast, Inc., Charlotte, N.C.

[21] Appl. No.: 534,429

[22] Filed: Jun. 7, 1990

[51] Int. Cl.[5] ..... B05B 15/06; B08B 3/02; B08B 3/08

[52] U.S. Cl. ..... 134/17; 134/23; 134/24; 134/34; 134/29; 134/144; 239/8; 239/9; 239/172; 239/532; 239/591; 239/654

[58] Field of Search ..... 134/17, 23, 24, 34, 134/144, 29; 239/8, 9, 172, 532, 591, 654

[56] References Cited

U.S. PATENT DOCUMENTS

| | | | |
|---|---|---|---|
| 3,799,443 | 3/1974 | Foster et al. | 239/163 |
| 3,829,024 | 8/1974 | Heden | 239/310 |
| 3,997,114 | 12/1976 | Hewett | 239/127 |
| 4,081,200 | 3/1978 | Cheung | 299/36 |
| 4,219,155 | 8/1980 | Goerss | 134/172 |
| 4,337,784 | 7/1982 | Goerss | 134/34 |
| 4,365,383 | 12/1982 | Bartlett | 134/172 |
| 4,597,720 | 7/1986 | Friedrichs | 417/419 |
| 4,603,661 | 8/1986 | Nelson et al. | 134/172 |
| 4,848,380 | 7/1989 | Francis et al. | 134/24 |

FOREIGN PATENT DOCUMENTS

WO85/02211 5/1985 PCT Int'l Appl. .

*Primary Examiner*—Theodore Morris
*Assistant Examiner*—Zeinab El-Arini
*Attorney, Agent, or Firm*—Bell Seltzer Park & Gibson

[57] ABSTRACT

The invention is a cleaning method and associated apparatus that are particularly useful for cleaning surfaces formed of relatively hard materials such as grout or industrial rolls which are contaminated with relatively hard embedded deposits of undesirable materials that are difficult to remove by conventional washing or abrading cleaning methods, and while substantially reducing the effluent resulting from the cleaning step so that the cleaning method may be conveniently used in areas where effluent disposal may be a problem such as smaller indoor rooms, areas, or equipment. The invention comprises pressurizing a cleaning liquid with a gas driven hydraulic pump and directing a flow of the cleaning liquid from a nozzle at surfaces to be cleaned at a pressure of at least about 5,000 pounds per square inch (psi) and at a volumetric flow rate of no more than about 1.5 gallons per minute (gpm), so that the pressure is sufficient to remove from the surface deposits of the type that cannot be removed by mechanical scrubbing using tools or chemical detergent action other than by damaging the surface itself, and in which the liquid flow rate at that pressure is small enough to prevent damage to the surface that would otherwise occur if the same pressure were used at a higher volumetric flow rate. A traversing device may also be used to move the nozzle across surfaces to be cleaned.

21 Claims, 5 Drawing Sheets

CLEANING METHOD

FIELD OF THE INVENTION

The present invention relates to a method and apparatus for cleaning deposits of undesirable material from hard surfaces, and in particular relates to a cleaning method and apparatus that use a high pressure flow of cleaning liquid at a low volumetric flow rate that may be directed toward a surface to clean it.

BACKGROUND OF THE INVENTION

In many environments, it is common for deposits of grime, dirt, chemical residues or other undesirable materials to accumulate on a variety of surfaces as a result of their ordinary, daily use. This problem occurs in domestic environments as well as in industrial applications. In some instances, these deposits may be merely unattractive, whereas in other situations, the deposits may impede the function of the article on which they have accumulated, or may even present a health or safety risk. Heretofore, a variety of means have been used to clean these deposits, including manual scrubbing with detergents or hard abrasive compounds. Alternatively, sandblasting and high pressure cleaning with large volumes of water, another cleaning liquid, or steam cleaning have also been used.

The known cleaning means such as those recited above, as well as other commonly available methods and apparatus, provide entirely satisfactory results in many applications. However, under certain conditions, these previously known apparatus and methods are inconvenient, inapplicable, or unsuccessful. One common example of a previously unresolved cleaning problem is the task of cleaning tile grout of the type commonly found in residential bathrooms and kitchens, in many commercial applications such as restaurants, or in hospital environments such as operating rooms.

Grout of the type used in conjunction with tile is a hard, porous ceramic material that is frequently white in color when newly applied between the tiles. It may also be tinted to a desired color in some instances. However, with the passage of time and years of use, white or tinted grout may become discolored due to deposits of dirt, grime, mildew, or other undesirable deposits that accumulate on the porous surface of the grout. These deposits cause the grout to assume a dark gray or even black coloration that is unappealing to most persons and which may disrupt the color scheme of the floor tiles. Moreover, these accumulations of grime may harbor amounts of bacteria or other substances that may present a health hazard under certain conditions. If the tile grout is located in a hospital surgical room, these accumulations can be particularly troublesome.

When used to clean tile grout, the known cleaning methods have not provided satisfactory results for a variety of reasons. As previously noted, tile grout is an extremely hard, porous, and brittle substance. Because the accumulated deposits are often retained within the porous interstices of the grout, mechanical cleaning methods such as a detergent and a scrub brush are often unable to reach the deposits to clean them with satisfactory results. Likewise, scrubbing with a steel wire brush also fails to produce satisfactory cleaning results because the grout material is harder than the steel wire, which results in the wire brush being worn away by the scrubbing action instead of the deposits or the grout material. Thus, these means have failed to give satisfactory, results in removing unwanted deposits from the grout.

Cleaning with high pressure fluids has also been attempted in the past but has given unsatisfactory results for different reasons than those noted above. Cleaning fluid sprays that have heretofore been used have been characterized by a high pressure spray having a high volumetric flow rate. Where a liquid spray is used to generate a cleaning force, the force created by the impact of the liquid upon the surface being cleaned may be represented by the following equation:

$$N = V\Gamma\sqrt{200\,P}$$

Wherein N equals the cleaning force in newtons, V equals the flow rate in cubic meters per second, Γ equals the specific weight of the liquid in kilograms per cubic meter and P is the pressure of the liquid in bars. As demonstrated by this equation, the cleaning force is directly proportional to the flow rate, and also to the square root of pressure. Thus, liquid spray cleaning devices have heretofore emphasized high flow rates rather than pressure to achieve a high cleaning force.

The high flow rate associated with typical pressurized liquid cleaning apparatus and methods generally renders them unacceptable for use in an indoor application, in which there is often no facility for disposing of the large quantities of liquid that are ejected by such a liquid spray. If such a cleaning spray were used to clean a tile floor, the effluent from the spray could reach several hundred gallons within a short period of time. As can readily be seen, such a volume cf effluent would be extremely difficult to contain or otherwise dispose of in a typical household or commercial application.

Another limitation associated with high flows of cleaning liquid arises from the so called "jackhammer" effect. This characteristic, which results from the use of a high volumetric flow rate of the cleaning liquid, may damage the grout or even destroy a portion of the floor surface by blowing out complete portions of the tile grout. Thus, there has been a need to circumvent the effluent discharge problems and the jackhammer effect associated with high volumetric flow rates used in conventional liquid cleaning systems.

Other problems associated with high volumetric flow rates of cleaning liquids appear when such sprays are used to clean deposits from rolls of the type used in handling web materials such as textiles and paper, as well as synthetic fibers in filament or tow form. Rolls are used in papermaking, printing, textile or fiber machinery to provide surfaces over which the paper, textile or fiber material may pass. When this occurs, any number of binders, residues, oligomers, finishes, inks, dyes or other chemical residues or deposits may accumulate on the surfaces of these rolls. Over time, a roll surface may become so covered with these materials that its function is impeded. Thus, these accumulated substances must be cleaned from the rolls periodically.

The roll cleaning task is a very challenging operation which often must be repeated frequently. In a typical production facility, some machines having rolls may need to be shut down as often as several times per day to have accumulated deposits cleaned from the rolls therein. This operation is generally accomplished by hand using sandpaper, emery cloth, brushes, steel wool or other abrasive means to clean the roll surfaces manually. Cleaning by these means is obviously a very time consuming process. Moreover, certain portions of such rolls may be difficult to reach by manual cleaning methods. Likewise, the use of high pressure cleaning methods heretofore known has not proved to be advantageous due to the high volumetric flow characteristic thereof, as discussed above. This characteristic presents the problem of disposing of the large liquid run off that results from a high volumetric liquid spray. The high liquid flow also presents cooling problems when used with heated rolls, as the high flow may cause cooling effects that may warp the roll material, thus causing structural damage to the roll. Even if the roll is not damaged, the cooling effects may require that heated rolls, such as those that are used for drying or temperature control, be reheated prior to restarting the machinery.

In the past, cleaning of surfaces using high pressure, low volumetric flows of liquid has been accomplished by using an intensifier pump to generate the high pressure, low volume flow of liquid. However, the use of intensifier pumps in this application has many drawbacks which cannot be overcome due to the inherent characteristics of intensifier pumps. For example, intensifier pumps are expensive, and they are large, bulky units which cannot be transported within confined spaces. Thus, cleaning with intensifier pumps may be restricted by size constraints. As a result, if cleaning is attempted in a confined area, it may be necessary to position the intensifier pump outside the room or building and to convey the high pressure cleaning liquid to the surface to be cleaned through tubing. Because high pressure liquids at the ranges of the present invention, e.g. between 5,000 and 36,000 psi, present extreme safety hazards, they must be contained within carefully constructed and closely monitored lines to avoid the risk of injury due to unintentionally released sprays. Many industrial facilities forbid the conveyance of such high pressure liquid flows over long distances through their facilities precisely to avoid the problems caused by these lines. Moreover, even where intensifier pumps have been used in the past, multiple guards have been needed to maintain surveillance of the high pressure liquid lines that extend from the intensifier pump to the surface being cleaned to ensure that the integrity of the lines is maintained and to make certain that no accidents cause high pressure liquid to be released accidentally.

In light of the aforementioned deficiencies, it is an object of the present invention to provide a new method and apparatus that are particularly useful for cleaning hard surfaces which contain relatively hard deposits of undesirable materials of the type that are difficult to remove by conventional washing or abrading cleaning. Another object of the present invention is to provide a cleaning method and apparatus that use a high pressure liquid flow for cleaning but which avoid the difficulties associated with high volumetric flow of the cleaning liquid. It is a further object of the present invention to provide a new method and apparatus that are particularly useful for cleaning tile grout. It is a further object of the present invention to provide a new method and apparatus that are particularly useful for cleaning roll surfaces. It is a further object of the present invention to provide a new method and apparatus that are particularly useful for cleaning heated roll surfaces while avoiding excessive cooling of the rolls.

SUMMARY OF THE INVENTION

The invention comprises a cleaning method and apparatus that are particularly useful for cleaning surfaces formed of relatively hard materials such as industrial rolls, grout and the like which are contaminated with relatively hard embedded deposits of undesirable materials that are difficult to remove by conventional washing or abrading cleaning. The method comprises pressurizing a cleaning liquid that is supplied at a generally moderate or ambient pressure with a gas driven hydraulic pump to generate a flow of that cleaning liquid at a higher pressure greater than about 5,000 psi that is sufficient to clean deposits from the surface that cannot otherwise be removed by mechanical scrubbing with tools or by chemical detergent action without causing damage to the surface. The flow of cleaning liquid is directed toward a surface to clean it at a low volumetric flow rate of less than about 1.5 gallons per minute to minimize the amount of effluent produced during cleaning and to prevent damage to the surface that would otherwise occur if the same pressure were used with a high volumetric flow of the fluid. A preferred embodiment of the invention uses a pressure of between about 8,000 and 9,000 psi at a flow rate of between about 0.3 and 0.5 gpm for cleaning grout, and a pressure of about 11,500 psi at a flow rate of about 0.75 gpm for removing deposits from machine surfaces such as industrial rolls. The invention also comprises apparatus for performing this method.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein.

DESCRIPTION OF THE PREFERRED EMBODIMENT

Figure 1:
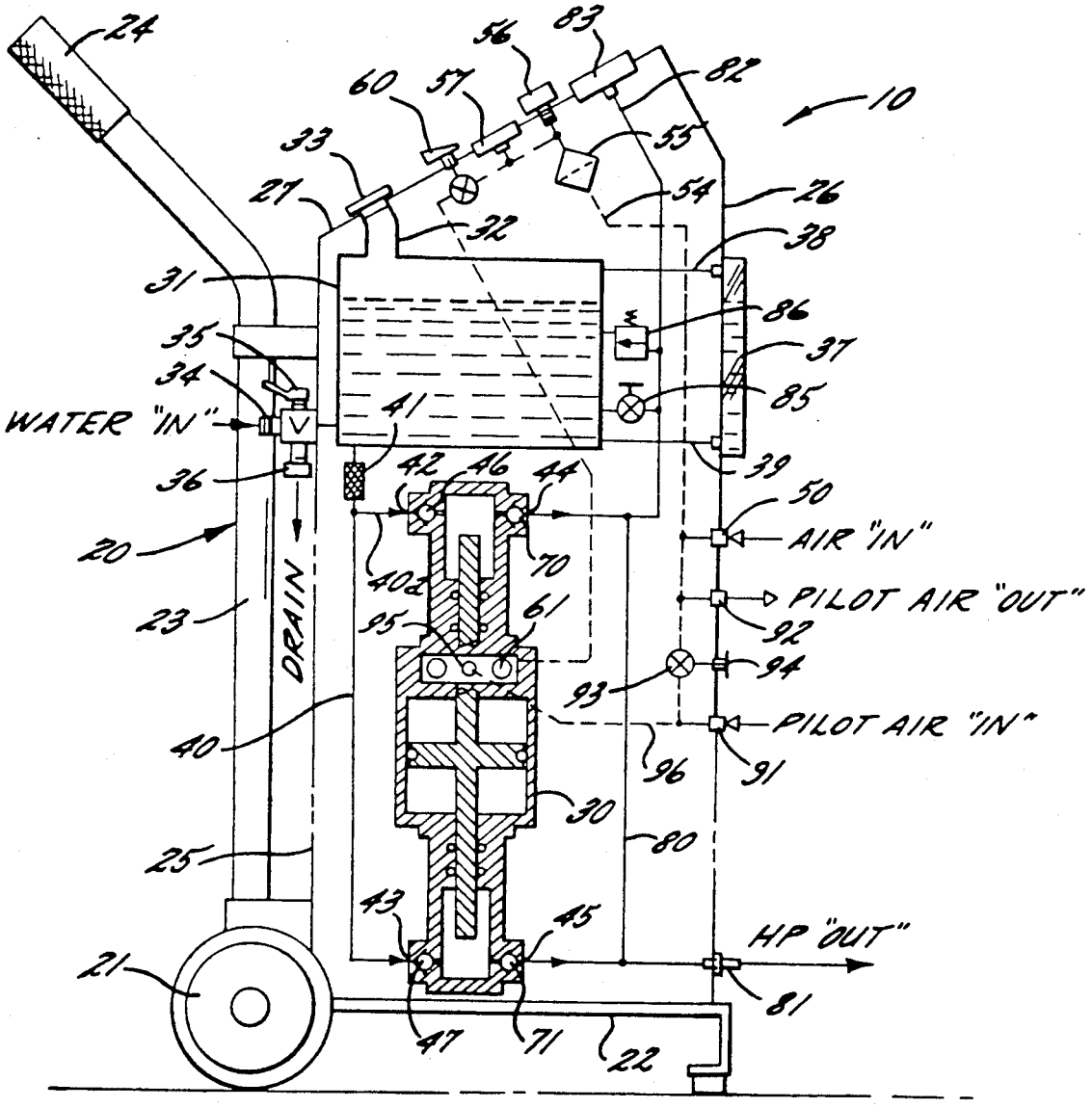
FIG. 1 is a cross sectional and partially schematic view of the portable power unit used in conjunction with the present invention.

The present invention is a cleaning method that is particularly useful for cleaning surfaces formed of relatively hard materials which are contaminated with relatively hard deposits of undesirable materials that are difficult to remove by conventional washing or abrading cleaning methods. The invention may be used to clean tile grout, which often harbors embedded deposits of dirt, grime, bacteria, or other contaminants which are difficult to remove by conventional methods. Likewise, the method may also be used to clean deposits from machine surfaces. The invention has been found to be particularly successful in cleaning deposits from industrial rolls used in equipment for handling web materials such as textiles, paper or for synthetic fibers in filament or tow form. The invention may be used to clean any number of tinders, residues, oligomers, finishes, inks, dyes or other chemical residues or deposits that periodically accumulate on the roll surfaces during operation of the machinery.

In a preferred embodiment that has been found successful in cleaning tile grout and roll surfaces, the invention is accomplished by directing a pressurized flow of a cleaning liquid toward a surface such as tile grout or a roll through a nozzle to remove deposits of undesirable materials therefrom. The cleaning liquid is received from a reservoir or other supply such as a hose and is passed through a pump to raise the pressure of the cleaning liquid to a desired level. In a preferred embodiment, the cleaning liquid is pressurized through the use of a gas driven hydraulic pump such as the Model 8HSFD-225 gas driven hydraulic pump manufactured and sold by Haskel, Inc. of Burbank, Calif. 91502. Alternatively, a miniature plunger pump may be used for this purpose.

The use of inexpensive gas driven hydraulic pumps as are used in the present invention to create such high pressure, low volumetric flows of water avoids the problems noted earlier that are presented by the use of intensifier pumps. Gas driven hydraulic pumps are significantly smaller than intensifier pumps, thus enabling them to be located at or close to the site being cleaned. This avoids the need to convey the highly pressurized cleaning liquid over long distances. Additionally, the small size of gas driven hydraulic pumps facilitates their incorporation into a small, portable unit that may easily be moved from location to location for cleaning. Also, because gas driven hydraulic pumps do not require electrical power for their operation, they may be used in hazardous environments such as areas containing solvents or other flammable materials without the risk of fire. Likewise, because electrical units may not be used in certain applications where sparks or fire are particular hazards, for example, within nuclear power generating facilities, gas driven hydraulic pumps are also well suited for use in cleaning surfaces in these facilities.

In the present invention, the cleaning liquid is pressurized by the gas driven hydraulic pump to at least about 5,000 pounds per square inch (psi), and for certain applications, it may be pressurized up to about 36,000 psi While so pressurized, however, the cleaning liquid is also forwarded from the pump at a flow rate of less than about 1.5 gallons per minute (gpm), and preferably between about 0.3 and 1.0 gpm. The flow of cleaning liquid is then directed via a hose to a nozzle which further directs the cleaning liquid toward the surface to be cleaned. In a preferred embodiment, the nozzle orifice is shaped to produce a flat spray.

It has been found that pressurizing the cleaning liquid to a pressure of at least about 8,000 psi and at a volumetric flow rate of no more than about 1.0 gpm is sufficient to remove from many surfaces deposits of the type that cannot be removed by mechanical scrubbing using tools or chemical detergent action other than by damaging the surface itself. In a preferred embodiment, when the invention is used to clean tile grout or the like, it has been found that a cleaning liquid pressure of between about 8,000 to 9,000 psi in conjunction with a volumetric flow rate of between about 0.3 and 0.5 gpm is sufficient to remove undesired deposits that are embedded in the grout. A preferred embodiment of the invention uses a pressure of about 9,000 psi and a volumetric flow rate of about 0.33 gpm to clean deposits from tile grout. Furthermore, it has been found that pressures of between about 10,000 psi and 15,000 psi are sufficient to clean most common undesired deposits from the surfaces of rolls used in textile, printing or fiber machinery at a volumetric flow rate of between about 0.5 to 1.5 gpm. When used to clean industrial rolls on web or fiber handling machinery, a preferred embodiment of the invention uses a pressure of about 11,500 psi at a flow rate of about 0.75 gpm. However, it is to be noted that pressures as high as 30,000 psi may sometimes be required to remove stubborn deposits from industrial rolls.

When cleaning deposits from surfaces that are indoors or are otherwise confined, or which are in tightly restricted machinery, it is desirable that the amount of effluent that results from use of a cleaning liquid be minimized. For example, many indoor areas are not equipped with drains or similar means for disposing of such effluent material. Accordingly, it is imperative that the volumetric flow rate of the cleaning liquid be kept as low as possible to provide adequate cleaning. As previously noted, it has been found that a volumetric flow rate of between about 0.3 and 1.5 gallons per minute is sufficient to clean tile grout or roll surfaces at pressures above 5,000 psi. In particular, a flow of about 0.33 gpm has been used with good results on grout, and a flow of about 0.75 gpm has been used with good effect on rolls. These small amounts of fluid flow reduce or eliminate the problems of disposing with effluent run off.

In operation, the exact pressure and flow rate used is selected by directing a flow of the cleaning liquid to a test surface and increasing the pressure thereof until a small deposit of undesirable material is removed. Thereafter, the desired water flow is determined by selecting a nozzle having the smallest orifice size that will give the desired cleaning results. Thus, the minimum pressure and flow rate combination may be selected for use in cleaning.

To improve cleaning results, the cleaning liquid may be preheated to a temperature of at least about 90°F. to enhance the cleaning performance thereof. Additionally, in particularly difficult environments, the surface to be cleaned may be pre-treated with a chemical such as an enzyme to soften accumulated deposits prior to directing the high pressure flow of cleaning liquid toward the surface.

Cleaning liquids that may be used in conjunction with the present invention include water, a solution of a cleaning compound and water, or some other liquid. A detergent may be added to the water for improved cleaning performance. In preferred embodiments, the water solution, or other cleaning liquid, is substantially free of abrasives or other particulate material. However, in applications requiring the removal of stubborn stains or deposits, water soluble abrasives may be injected into the stream of cleaning liquid by a venturi-injector after the stream is ejected from the nozzle. Preferred abrasives are salt and baking soda. Baking soda is especially suited for many applications due to its sterilizing effect on the surface on which it is sprayed. The use of such soft abrasives combines the soft abrasive effect with the cleaning effect of the cleaning liquid spray.

The present invention may also include the step of collecting the cleaning liquid after it has been directed at a surface to be cleaned, and forwarding the collected cleaning liquid to a reservoir for subsequently transporting the effluent to a disposal site. Alternatively, the collected cleaning liquid may be directly communicated to a drain which may be remote from the surface being cleaned. As yet another alternative, the collected cleaning liquid may be filtered and returned to the pump for repressurization and further use in cleaning.

Figure 2:
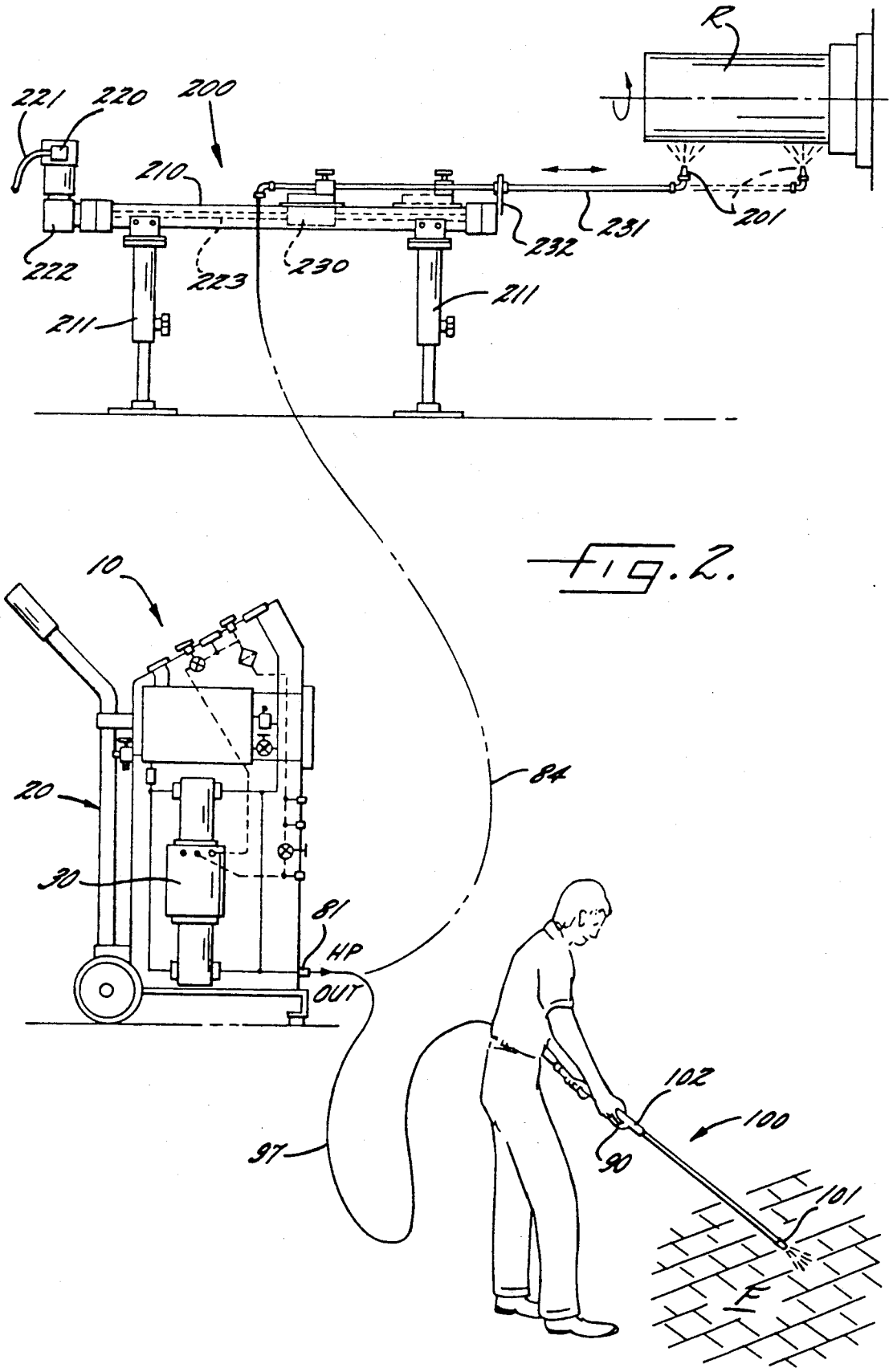
FIG. 2 illustrates possible alternative uses for the present invention.

The invention includes an apparatus for performing the above method, as illustrated in the drawings. FIG. 1 shows a portable power unit 10 for use in conjunction with the present invention. The invention may be used for cleaning, restoration, polishing and edging of many different surfaces which may be contaminated with deposits of accumulated substances. As shown in FIG. 2, the invention may be used to clean a hard floor F or other interior surface made of a material such as tile or concrete. The present invention has been found to be particularly useful in cleaning unwanted deposits of materials such as grime or dirt from the grout placed between tiles. Also as shown in FIG. 2, the present invention may be used to clean portions of machinery such as a roll R or vessels, plates or other surfaces that have become contaminated with deposits such as dirt, latex or acrylic binders, finish oils, waxes, paint, plastic deposits or oligomer deposits.

The portable power unit 10 includes a frame 20 that is mounted on wheels 21 and which has a bottom frame 22 and vertical structural tubing 23. A handle 24 is positioned at the upper end of the vertical tubing 23 so that the power unit 10 may be easily transported between various locations by tilting the portable power unit 10 about the wheels 21 and rolling the power unit to a desired location. A bottom frame 22 supports a housing 25, which may be constructed of metal, plastic, wood or other suitable sheet material. The housing has four sides 26 and a canted top surface 27 which enclose the operative components of the portable power unit 10. An upper canted surface 27 of the housing 25 also provides a site for various gauges, controls and other operational equipment. The sides of the housing 25 provide support for other operational equipment as well, and also serve as a safety shield for the high pressure components contained therein.

A gas driven hydraulic pump 30 as described earlier is enclosed within the housing 25 and above the bottom frame 22. In a preferred embodiment, the gas driven pump may be driven by air. The apparatus includes fluid receiving means illustrated as the liquid reservoir 31 that is provided in the upper regions of the housing 25 to receive a supply of cleaning liquid such as water, a water based cleaning compound such as a detergent mix, or some other type of liquid. The reservoir 31 may receive a cleaning liquid either through a filling port 32 after removal of the cap 33, or through a water inlet 34 and water inlet valve 35. In the illustrated embodiment, the water inlet 34 is threaded with male threads to engage the female end of a water hose of the sort commonly found in domestic and industrial environments. The water inlet valve 35 also communicates with a drain opening 36 which provides means for emptying the liquid within the liquid reservoir 31.

The reservoir 31 communicates with a liquid level gauge 37 through the upper and lower gauge tubing 38 and 39. The liquid level gauge 37 is mounted on the side 26 of the housing 25 so that an operator using the portable power unit 10 may visually determine the level of fluid remaining in the reservoir 31.

Liquid from the reservoir 31 is communicated to the gas driven hydraulic pump 30 through a water feed line 40. A liquid filter 41 is provided within the water feed line 40 to ensure that the liquid provided to the pump 30 is clean and free of particulate matter. Typically, liquid supplied to the pump 30 by the feed line 40 is at moderate pressure such as atmospheric pressure, which is about 14.7 psi. Alternatively, if the liquid is supplied by a hose, it may be at moderate pressures typical of industrial or domestic water supplies, which are generally in a range between about 50 and 140 psi.

In a preferred embodiment, the gas driven hydraulic pump 30 is a double acting output pump with two liquid input ports 42 and 43 and two liquid output ports 44 and 45. Such a pump advantageously delivers pressurized liquid during both of its reciprocating strokes. The liquid feed line 40 divides into two feed lines **40*a* and 40 to supply the upper and lower liquid inlets 42 and 43, respectively, of the gas driven hydraulic pump 30. The liquid inlets 42 and 43 further conduct the liquid through two inlet check valves 46 and 47 that restrict high pressure water from flowing backward into the feed lines 40*a* and 40**.

Figure 3:
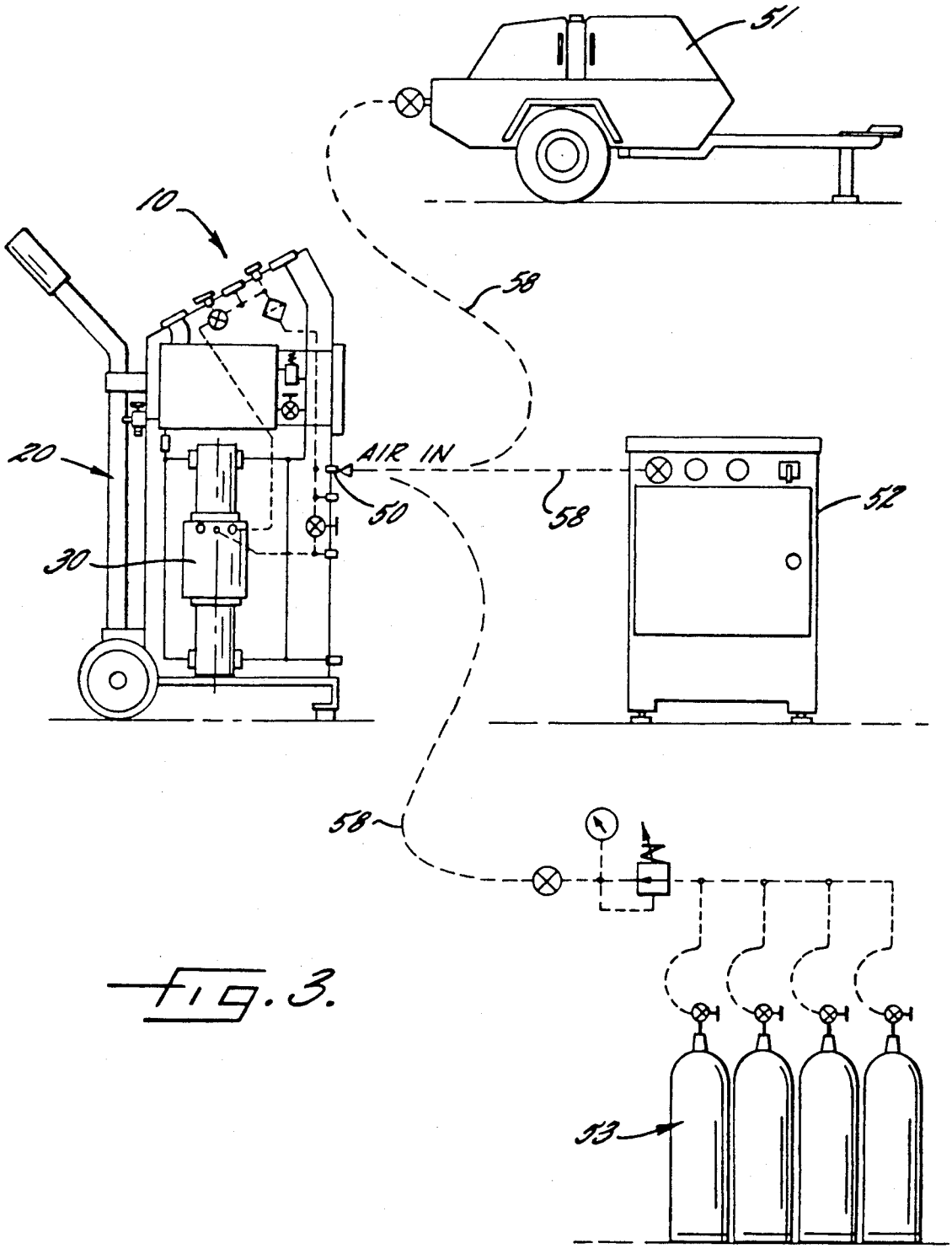
FIG. 3 illustrates alternative sources of high pressure air that may be used to drive the portable power unit of the present invention.

The housing 25 also supports an air inlet 50 that provides air receiving means for receiving a supply of pressurized air at a pressure of between about 80 to 110 psi such as may commonly be found in industrial environments. The pressurized air received through the inlet 50 is used to drive the gas driven hydraulic pump 30. As shown in FIG. 3, the air inlet 50 may receive a supply of air either from a portable compressor 51, an industrial air supply system 52, or air storage cylinders 53, through the respective hoses shown schematically at 58. FIG. 1 shows that the air received by the air inlet 50 is communicated through the air supply tubing 54 via an air filter 55 and to a pressure regulator 56 mounted on the upper canted surface 27 of the housing 25. The pressure regulator 56 reduces the pressure of air supplied to the gas driven hydraulic pump 30 to a level that is adjusted so that the air will drive the pump 30 to generate a flow of cleaning liquid at the desired pressure. In a preferred embodiment, the regulator 56 reduces the pressurized air to a level of between about 35 to 80 psi. Reducing the air pressure to this level also permits the pump 30 to be run for extended periods without encountering freeze problems at the pump exhaust that otherwise would result from expansion of the exhausting air.

After passing through the pressure reducer 56, the air supply tubing 54 carries the pressurized air supply to a pressure gauge 57 and a shutoff valve 60. Thereafter, the air supply tubing 54 communicates with a supply air inlet 61 of the gas driven hydraulic pump 30 to drive it in operation.

When the gas driven hydraulic pump 30 is actuated, high pressure liquid is conducted through outlet check valves 70 and 71 in the pump 30 to a high pressure liquid outlet tubing so. It has been found that a cleaning liquid pressure of at least about 5,000 psi as measured near the output ports 44 and 45 of pump 30, and at a flow rate of more than about 1.0 gpm is preferred for many cleaning applications. One embodiment for grout cleaning utilizes a pressure of between about 8,000 and 9,000 psi and a volumetric flow rate of between about 0.3 and 0.5 gpm, and preferably, a pressure of about 9,000 psi and a flow rate of about 0.33 gpm. Furthermore, ar embodiment of the invention for cleaning industrial rolls of the sort used in paper, textile or fiber equipment uses pressures of between about 10,000 and 15,000 psi and a flow rate of between about 0.5 and 1.5 gpm. The preferred embodiment used for roll cleaning utilizes a pressure of about 11,500 psi at a flow rate of about 0.75 psi. However, pressures up to about 30,000 psi may be used to clean stubborn deposits from rolls.

The outlet tubing 80 carries pressurized cleaning liquid to a high pressure liquid outlet 81 and also to auxiliary tubing 82, which further communicates with a liquid pressure gauge 83 mounted on the upper canted surface 27 of the housing 25. As shown schematically in FIG. 2, the high pressure liquid outlet 81 may be attached to a supply hose shown schematically at 84 to discharge liquid for a variety of cleaning applications.

Pilot air is supplied to a trigger unit 90 via a pilot air inlet 91 and a pilot air outlet 92. The trigger 90 is used to Control pilot air which operates a cycling valve in pump 30, thereby to interrupt the pressurized air supplied to the gas driven hydraulic pump 30 by the air supply tubing 54. This arrangement permits an operator to start or stop the function of the gas driven hydraulic pump 30. A pilot valve 93 is positioned in the air supply tubing 54 that extends between the pilot air inlet 91 and the outlet 92. The pilot valve 93 may be short circuited by a switch 94 to operate the pump 30 without the use of the trigger 90. Pilot air communicates with a pump pilot air inlet 95 via pilot tubing 96. Pump pilot air inlet further leads pilot air to the cycling valve (not shown) of pump 30.

The high pressure liquid outlet tubing so further communicates with the liquid reservoir 31 through the auxiliary tubing 82. Liquid carried by the auxiliary tubing 82 is directed to a priming valve 85 and a pressure relief valve 86. The priming valve 85 may be opened before commencing use of the portable power unit 10 so that liquid from the reservoir 31 may drain by force of gravity into the high pressure liquid outlet tubing so to prime the system. The pressure relief valve 86 is provided as a safety feature to open if the pressure in the high pressure liquid outlet tubing so exceeds a predetermined level. The pressure relief valve 86 communicates with the liquid reservoir 31 so that opening of the pressure relief valve 86 will return any discharged liquid to the reservoir 31.

As shown in FIG. 2, the portable power unit 10 is adapted to be used in conjunction with either a manual spray unit 100 or with a traversing device 200. In each instance, the supply hose 84 connects to the high pressure liquid outlet 81 of the power unit 10 to communicate the high pressure liquid produced by the gas driven hydraulic pump 30 to a nozzle 101 or 201 for spraying in the direction of a contaminated surface.

When used manually, the supply hose 84 communicates the high pressure liquid to a manual spraying unit 100 which includes a handle 102 and the nozzle 101. The trigger 90 is also provided at the handle 102 which communicates with the pilot inlet 91 and outlet 92 through an external pilot tubing 97. The external pilot tubing 97 and the supply hose 84 may be joined or wrapped around one another to provide a single line extending from the portable power unit 10 to the manual spray unit 100. Operation of the trigger 90 permits an operator to control the operation of the gas driven hydraulic pump 30 while at a location remote from the portable power unit 10. This trigger arrangement provides a safety feature in that the flow of high pressure liquid to the nozzle 101 may be interrupted without the use of a valve in the manual spray unit 100 to restrict the flow of high pressure liquid. This is because the operation of the pump 30 is interrupted by trigger unit 90 which shifts the cycling valve of pump 30, thereby closing the air supply that drives pump 30. Thus, the supply hose 84 is not charged by the pump 30 when the nozzle 101 is not in operation. Also, the use of a low volumetric flow rate through nozzle 101 provides an added safety feature in that the high pressure dissipates quickly and does not extend beyond regions in close proximity to the nozzle 101, thus reducing the danger of operating the cleaning apparatus or of using the cleaning method in those areas.

Nozzle 101, or any nozzles 201 and 322 used in conjunction with the traversing device of the present invention, is in a preferred embodiment, a flat spray nozzle. The spray from this nozzle is directed at a acute angle of between about 10° and 25° relative to the surface being cleaned. The nozzle orifice may be between 7/1000 of an inch and 18/1000 of an inch depending on the particular application. Flat spray nozzles are desired because they provide better cleaning performance and faster results than does the use of round nozzles. Nozzles 101, 201 or 322 may be made of tungsten carbide or sapphire. It has been found that filtering the cleaning liquid through a 2 micron filter allows the use of a tungsten carbide nozzle at the pressures used by the present invention with significantly increased service life.

FIG. 2 also shows one embodiment of the traversing device 200 that may be used in conjunction with the portable power unit 10 to move the nozzle 201 across the surface of a roll R or other machine component having a longitudinally oriented surface. The traversing device 200 may have any of several drive systems, as will be explained hereinbelow; however, regardless of the drive system used, the main function of the traversing device 200 is to provide lateral motion to the nozzle 201 to ensure uniform and complete spraying of a surface.

When used to clean an industrial machine roll, the traversing device 200 moves the nozzle 201 through a horizontal plane in close conjunction with the surface of a roll R so that a high pressure spray may be directed thereon. The roll R is generally rotated during this process so that the turning of the roll R and the lateral motion of the nozzle 201 produce complete cleaning of the surface of the roll R.

As shown in FIG. 2, one embodiment of the traversing device 200 uses a generally horizontal platform 210 supported above a floor surface by adjustable supports 211. The horizontal platform 210 may be raised or lowered by the adjustable supports 211. The adjustable supports 211 illustrated in FIG. 2 are manually operated. But the supports 211 may include hydraulic or pneumatic cylinders or similar power drive systems that may be engaged to raise or lower the level of the horizontal platform 210.

The embodiment of the traversing device 200 shown in FIG. 2 uses an electric motor 220 connected to a source of current by a power cord 211. The electric motor 220 produces rotary motion that is transferred to a right angle reducing gear 222. The operation of the electric motor 220 is determined by an adjustable control unit so that an operator may set the length over which he desires the nozzle 201 to move. Likewise, the control unit may be used by an operator to select the speed at which the nozzle 201 is moved by the traversing device 200.

A rotating spindle 223 that can be a threaded or spiralled shaft is driven by the right angle reducing gear 222 extends lengthwise through the horizontal platform 210. The spindle 223 engages a traversing unit 230. The traversing unit 230 includes a wand 231 and is moved by a spindle drive that includes appropriate gear-type teeth (not shown) on traversing unit 230 that engage the spindle 223 to be driven along the length of the traversing device 200 by rotation of the spindle 223. The nozzle 201 is provided at one end of the wand 231 so that high pressure liquid is communicated from the portable power unit 10 through the supply hose 84 to the wand 231 and on to the nozzle 201. The wand 231 also extends through a wand support 232 carried by the horizontal platform 210.

Figure 4:
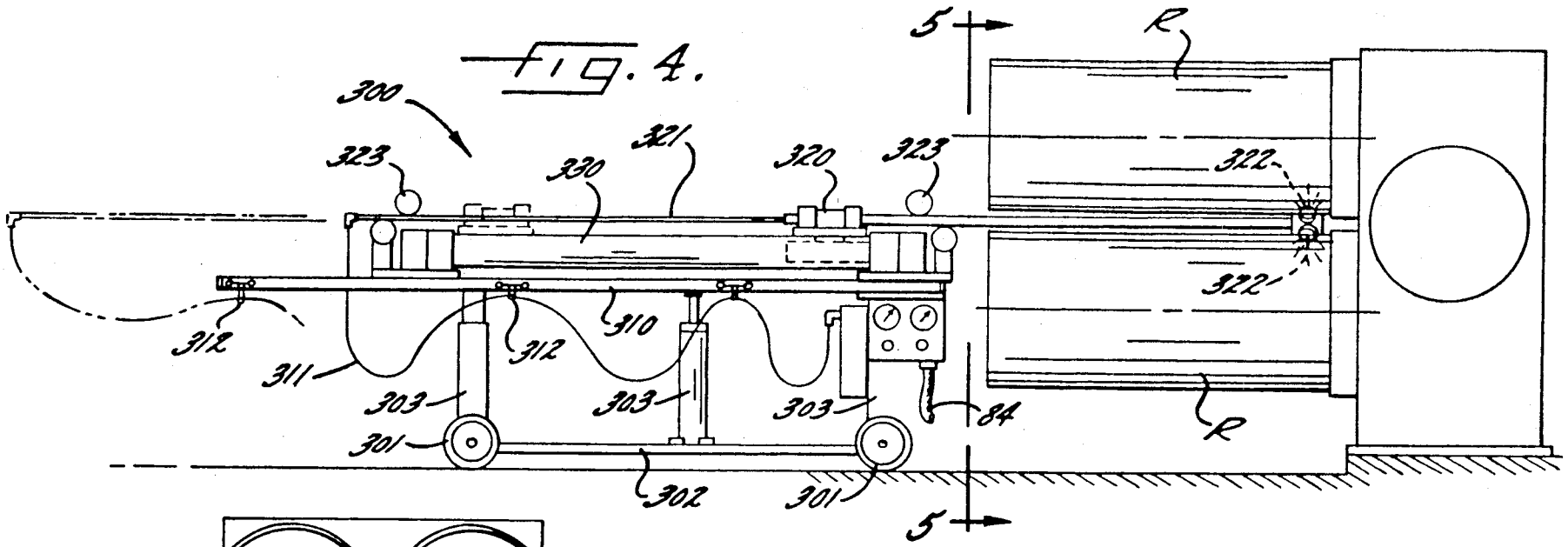
FIG. 4 is a side elevational view of a traversing device in accordance with the present invention.
Figure 5:
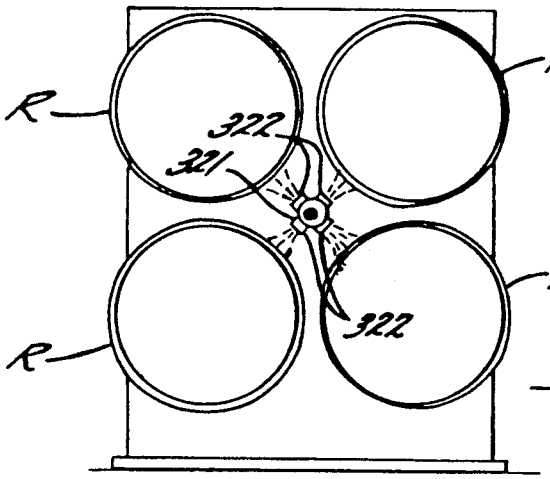
FIG. 5 is a cross sectional view taken along lines 5—5 of FIG. 4.
Figure 6:
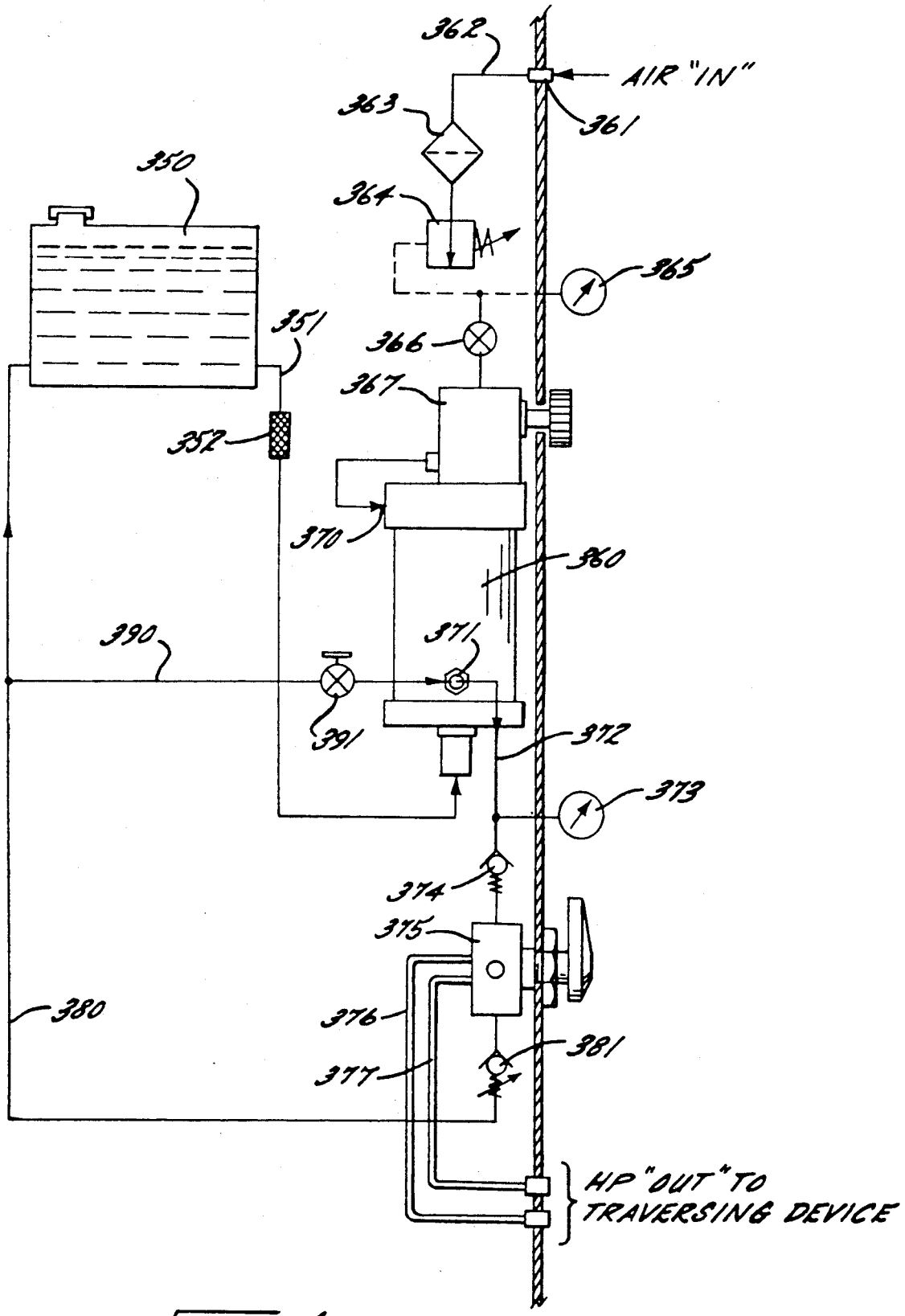
FIG. 6 is a cross sectional and partially schematic view illustrating the construction of the hydraulic drive used for the traversing device of the present invention.

Another embodiment of a traversing device is shown in FIGS. 4, 5 and 6. This embodiment is a hydraulic traversing device 300 in which a hydraulic system is used to impart lateral motion to at least one nozzle 322 and to adjust the vertical positioning thereof. The embodiment depicted in FIG. 4 includes wheels 301 that carry a bottom carriage 302. Adjustable supports 303 extend upwardly from the bottom carriage 302 to support a horizontal platform 310. The adjustable supports 303 may be hydraulic cylinders operated from the same hydraulic system used to operate the remainder of the hydraulic traversing device 300.

The horizontal platform 310 supports a traversing slide 320. The motion of the traversing slide 320 is provided by a hydraulic cylinder 330 positioned horizontally within the horizontal platform 310.

High pressure liquid is communicated from the portable power unit 10 to the hydraulic traversing device 300 through the supply hose 84. A wand supply hose 311 further communicates high pressure liquid to the wand 321. The wand supply hose 311 is supported by a plurality of hangers 312 depending from the horizontal platform 310. The wand 321 further communicates high pressure liquid to at least one nozzle 322. Wand rollers 323 support the wand 321 so it may be moved laterally by the traversing slide 320.

As shown in FIG. 5, a plurality of the nozzles 322 may be provided at the end cf the wand 321 to permit simultaneous cleaning of multiple roll surfaces R. The example illustrated in FIG. 5 shows four nozzles 322 arranged around the periphery of the wand 321 so that four sprays of high pressure liquid may be directed 90° apart from each other. It is to be noted, however, that other nozzle arrangements may be used to facilitate cleaning of different roll configurations, or different numbers of rolls. Also, multiple nozzles 322 may be directed to a single surface to remove deposits that are particularly difficult to remove, or for speed cleaning.

The drive system for the hydraulic traversing device 300 is illustrated schematically in FIG. 6. An hydraulic reservoir 350 is provided to supply a hydraulic fluid to the hydraulic system. Alternatively, reservoir 350 may be replaced by reservoir 31 of portable power unit 10 so that reservoir 31 provides a common source of liquid for power unit 10 and traversing device 300.

Hydraulic fluid from the hydraulic reservoir 350 or liquid reservoir 31 is communicated to an air driven hydraulic pump 360 through a hydraulic supply tubing 351. A filter 352 is positioned near the outlet of the hydraulic reservoir 350 to ensure cleanliness of the hydraulic fluid. The air driven hydraulic pump 360 is operated from pressurized air received by air supply inlet 361 which can accept pressurized air from either of the sources shown attached to the portable power unit 10 in FIG. 3; i.e. a portable compressor 51, industrial air supply 52 or air storage cylinders 53.

The pressurized air received through the air supply inlet 361 is communicated by an air supply tubing 362 to an air filter 363, through ar air regulator 364, to an air pressure gauge 365 and through a shut off valve 366. Thereafter, pressurized air is communicated to a cycle timer 367 which regulates the supply cf pressurized air to the air driven hydraulic pump 360. A cycle timer 367 is used to adjust the speed of operation of the traversing device 300 by adjusting the amount of hydraulic fluid injected into the hydraulic cylinder 330 by the pump 360. This adjustment feature permits an operator to vary the longitudinal motion of the nozzle 322 to achieve the desired cleaning results. In a preferred embodiment, the cycle timer 367 may be adjusted over a range of between about four cycles per minute to about 200 cycles per minute, which results in changing the speed of motion of the nozzles 322 from about 0.02 meters per minute to about 1.0 meter per minute.

The pump 360 pressurizes the hydraulic fluid such as water or other liquid that is communicated to it through a pump inlet 370. After pressurization by the pump 360, the hydraulic fluid is communicated from the high pressure outlet 371 of the pump 360 by ar outlet tubing 372 to a high pressure gauge 373 and past a check valve 374 to a four-way valve 375. The four-way valve 375 is provided to direct the flow of hydraulic fluid to a horizontal hydraulic cylinder 330 that is positioned within the horizontal platform 310 of the hydraulic traversing device 300. Hydraulic fluid is communicated from the four-way valve 375 to the cylinder 330 by cylinder supply tubing 376 and 377. The four-way valve 375 controls the routing of the hydraulic fluid to the hydraulic cylinder 330 to achieve lateral motion of the nozzles 322 in opposing directions.

Hydraulic fluid exiting the four-way valve 375 is communicated to the hydraulic reservoir 350 by a hydraulic return tubing 380. A return check valve 381 is provided within the hydraulic return tubing 380 to control the pressure within the hydraulic cylinder 330. In a preferred embodiment, the return check valve 381 is adjusted so that the piston pressure is about 50 psi.

Priming tubing 390 extends from the pump 360 to a priming valve 391 and on to the hydraulic return tubing 380. The priming valve 391 is positioned in the priming tubing 390 to provide means for priming the pump 360 with hydraulic fluid from reservoir 350. In a preferred embodiment, the control valve 391 is adjusted so that the piston pressure is about 50 psi.

Another embodiment of the traversing device may be powered by an electric motor powered rack and pinion drive system.

As set forth earlier, the present invention also includes the method of using the above described apparatus.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. A cleaning method that is particularly useful for cleaning surfaces formed of relatively hard materials which are contaminated with relatively hard embedded deposits of undesirable materials that are difficult to remove by conventional washing or abrading cleaning methods, and while substantially reducing the effluent resulting from the cleaning step so that the cleaning method may be conveniently used in areas where effluent disposal may be a problem such as smaller indoor rooms, areas, or equipment, the method comprising pressurizing a cleaning liquid with a gas driven hydraulic pump located at or close to a surface to be cleaned and directing a flow of the cleaning liquid from the gas driven hydraulic pump toward a surface to be cleaned at a pressure of between about 5,000 and 15,000 pounds per square inch (psi) and at a volumetric flow rate of greater than about 0.3 and less than 1.0 gallons per minute (gpm), so that the pressure of the cleaning liquid being directed toward the surface is sufficient to remove from the surface deposits of the type that cannot be removed by mechanical scrubbing, using tools or chemical detergent action other than by damaging the surface itself, and in which the volumetric flow rate at that pressure is small enough so that the liquid flow does not cause damage to the surface that would otherwise occur if the same pressure were used at a higher volumetric flow rate.

2. A cleaning method according to claim 1 wherein the step of directing a cleaning liquid to the surface comprises directing water that is substantially free of abrasives or other particulate matter.

3. A cleaning method according to claim 1 wherein the step of directing a flow of cleaning liquid towards surfaces to be cleaned comprises directing the cleaning liquid through a nozzle, and further comprising the step of injecting water soluble abrasives such as salt or baking soda into the cleaning liquid after the liquid has passed through the nozzle.

4. A cleaning method according to claim 1 wherein the step of directing a flow of a cleaning liquid comprises directing a water solution of a cleaning compound.

5. A cleaning method according to claim 2 wherein the step of directing water to a surface further comprises supplying water from a water supply at moderate pressure to the gas driven hydraulic pump that raises the pressure of the water from the moderate pressure to a pressure of between about 8,000 and 9,000 psi and at a volumetric flow rate of between about 0.3 and 0.5 gpm.

6. A cleaning method according to claim 5 wherein the step of supplying water at moderate pressure to a gas hydraulic pump comprises forwarding the water at a pressure of between about 50 to 140 psi which is characteristic of normal domestic or industrial water supplies.

7. A cleaning method according to claim 5 wherein the step of supplying water at moderate pressure to a gas driven hydraulic pump comprises forwarding the water from a reservoir at substantially atmospheric pressure.

8. A cleaning method according to claim 2 wherein the step of directing the high pressure water to a surface comprises directing the water in a spray at a flow rate of about 0.33 gallons per minute.

9. A cleaning method according to claim 2 further comprising the step of heating the water to a temperature of at least about 90° F. to enhance cleaning performance.

10. A cleaning method according to claim 1 further comprising the step of collecting the cleaning liquid after it has been directed at a surface to be cleaned.

11. A cleaning method according to claim 2 wherein the step of directing water to a surface further comprises supplying water from a water supply at moderate pressure to the gas driven hydraulic pump that raises the pressure of the water rom the moderate pressure to a pressure of between about 10,000 and 15,000 psi at a volumetric flow rate of about 0.75 gpm.

12. A cleaning method that is particularly useful for cleaning surfaces formed of relatively hard material such as grout which are contaminated with relatively hard embedded deposits of undesirable materials that are difficult to remove by conventional washing or abrading cleaning methods, and while substantially reducing the effluent resulting from the cleaning step so that the cleaning method may be conveniently used in areas where effluent disposal may be a problem such as smaller indoor rooms, areas, or equipment, the method comprising directing a cleaning liquid at a moderate pressure to a gas driven hydraulic pump located at or close to a surface to be cleaned; raising the pressure of the cleaning liquid with the gas driven hydraulic pump from the moderate pressure to a pressure of between about 5,000 and 15,000 psi near the pump; directing the cleaning liquid form the pump to a flat spray nozzle at a volumetric flow rate of greater than about 0.3 and less than 1.0 gpm; and ejecting the cleaning liquid in a spray from the nozzle with the nozzle placed in close proximity to a surface to remove undesirable embedded deposits from the surface without causing damage to the surface which would occur if a liquid spray having the same pressure and a higher volumetric flow rate were used.

13. A cleaning method according to claim 12 wherein the step of raising the pressure of the cleaning liquid from the moderate pressure comprises raising the pressure to a pressure of between about 8,000 and 9,000 psi.

14. A cleaning method according to claim 12 wherein the step of directing the cleaning liquid to a nozzle comprises directing the liquid at a volumetric flow rate of between about 0.3 and 0.5 gpm.

15. A cleaning method according to claim 12 wherein the step of ejecting the cleaning liquid in a spray from a nozzle comprises ejecting the spray from the nozzle while dissipating the force of the pressurized cleaning fluid within a short distance of being ejected from the nozzle to thereby reduce the force presented by the pressurized cleaning liquid at locations not in close proximity to the nozzle.

16. A cleaning method according to claim 12 further comprising the step of moving the nozzle across the surface so that the flat spray is directed to the surface at a spray angle of between about 10 and 25 degrees.

17. A cleaning method according to claim 12 further comprising the step of filtering the cleaning liquid before it is directed to the nozzle to thereby increase the service life of the nozzle.

18. A method of cleaning industrial rolls such as the type useful in the production and processing of paper, textiles, other web materials, and synthetic fibers, which are contaminated with relatively hard deposits of undesirable materials that are difficult to remove by conventional washing or abrading cleaning methods, and while substantially reducing the effluent resulting from the cleaning step so that the cleaning method may be conveniently used in areas such as within equipment where effluent disposal may be a problem, the method comprising:

pressurizing a cleaning liquid with a gas driven hydraulic pump located near a surface to be cleaned from a moderate pressure between about 14.7 psi and 140 psi to a pressure of about 11,500 psi at a flow rate of about 0.75 gpm;

directing the cleaning liquid to a flat spray nozzle;

further directing the cleaning liquid from the flat spray nozzle to a surface to be cleaned; and moving the nozzle across the surface of the roll with a power driven traversing device to ensure uniform and complete spraying of a surface.

19. A cleaning method according to claim 18 further comprising the step of adding water soluble abrasives such as salt or baking soda to the cleaning liquid prior to directing the cleaning liquid from the nozzle.

20. A cleaning method according to claim 18 including rotating the roll during the step of traversing the surface of the roll.

21. A cleaning method according to claim 18 wherein the step of moving the nozzle over the surface of the roll comprises moving the nozzle at such a rate so that the cleaning liquid directed to the surface from the nozzle will not significantly cool the surface of a heated roll.

* * * * *

UNITED STATES PATENT AND TRADEMARK OFFICE

CERTIFICATE OF CORRECTION

PATENT NO. : 5,116,425

DATED : May 26, 1992

INVENTOR(S) : Helmut Ruef

It is certified that error appears in the above-identified patent and that said Letters Patent is hereby corrected as shown below:

At column 8, line 60, "so" should be --80--.

At column 8, line 68, "ar" should be --an--.

At column 9, line 32, "so" should be --80--.

At column 9, line 39, "so" should be --80--.

At column 9, line 42, "so" should be --80--.

At column 14, line 27, "form" should be --from--.

Signed and Sealed this

Twentieth Day of July, 1993

*Attest:*

Michael K. Kirk

MICHAEL K. KIRK

*Attesting Officer*

*Acting Commissioner of Patents and Trademarks*